US010221637B2

(12) United States Patent
Xu et al.

(10) Patent No.: US 10,221,637 B2
(45) **Date of Patent: *Mar. 5, 2019**

(54) METHODS OF MANUFACTURING DISSOLVABLE TOOLS VIA LIQUID-SOLID STATE MOLDING

(71) Applicants: Zhiyue Xu, Cypress, TX (US); Bobby Salinas, Sugar Land, TX (US); Zhihui Zhang, Katy, TX (US)

(72) Inventors: Zhiyue Xu, Cypress, TX (US); Bobby Salinas, Sugar Land, TX (US); Zhihui Zhang, Katy, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 204 days.

This patent is subject to a terminal disclaimer.

(21) Appl. No.: 14/823,491

(22) Filed: Aug. 11, 2015

(65) Prior Publication Data

US 2017/0044675 A1 Feb. 16, 2017

(51) Int. Cl.

| | |
|---|---|
| ***E21B 23/00*** | (2006.01) |
| ***B22D 1/00*** | (2006.01) |
| ***B22D 17/00*** | (2006.01) |
| ***B22D 19/06*** | (2006.01) |
| ***B22D 19/14*** | (2006.01) |
| ***B22D 21/00*** | (2006.01) |
| ***B22D 27/02*** | (2006.01) |
| ***B22D 27/08*** | (2006.01) |

(52) U.S. Cl.

CPC ..... *E21B 23/00* (2013.01); *B22D 1/007* (2013.01); *B22D 17/007* (2013.01); *B22D 19/06* (2013.01); *B22D 19/14* (2013.01); *B22D 21/00* (2013.01); *B22D 27/02* (2013.01); *B22D 27/08* (2013.01)

(58) Field of Classification Search

CPC ..... E21B 23/00; B22D 1/007; B22D 17/007; B22D 19/06; B22D 19/14; B22D 21/00; B22D 27/02; B22D 27/08

See application file for complete search history.

(56) References Cited

U.S. PATENT DOCUMENTS

| | | | |
|---|---|---|---|
| 1,468,905 | A | 9/1923 | Herman |
| 1,558,066 | A | 10/1925 | Veazey et al. |
| 2,189,697 | A | 2/1940 | Baker |
| 2,222,233 | A | 11/1940 | Mize |
| 2,225,143 | A | 12/1940 | Baker et al. |
| 2,238,895 | A | 4/1941 | Gage |
| 2,261,292 | A | 11/1941 | Salnikov |
| 2,294,648 | A | 9/1942 | Ansel |
| 2,301,624 | A | 11/1942 | Holt |
| 2,352,993 | A | 7/1944 | Albertson |
| 2,394,843 | A | 2/1946 | Cooke et al. |
| 2,672,199 | A | 3/1954 | McKenna |
| 2,753,941 | A | 7/1956 | Hebard et al. |
| 2,754,910 | A | 7/1956 | Derrick et al. |
| 2,933,136 | A | 4/1960 | Ayers et al. |
| 2,983,634 | A | 5/1961 | Budininkas et al. |
| 3,057,405 | A | 10/1962 | Mallinger |
| 3,066,391 | A | 12/1962 | Vordahl |
| 3,106,959 | A | 10/1963 | Huitt et al. |
| 3,142,338 | A | 7/1964 | Brown |
| 3,152,009 | A | 10/1964 | Delong |
| 3,180,728 | A | 4/1965 | Keir et al. |
| 3,196,949 | A | 7/1965 | Thomas |
| 3,226,314 | A | 12/1965 | Wellington et al. |
| 3,242,988 | A | 3/1966 | McGuire et al. |
| 3,316,748 | A | 5/1967 | Lang et al. |
| 3,326,291 | A | 6/1967 | Zandmer et al. |
| 3,343,537 | A | 9/1967 | Graham |
| 3,347,317 | A | 10/1967 | Zandemer |
| 3,347,714 | A | 10/1967 | Broverman et al. |
| 3,390,724 | A | 7/1968 | Caldwell |
| 3,395,758 | A | 8/1968 | Kelly et al. |
| 3,406,101 | A | 10/1968 | Kilpatrick |
| 3,416,918 | A | 12/1968 | Roberts |
| 3,465,181 | A | 9/1969 | Colby et al. |
| 3,489,218 | A | 1/1970 | Means |
| 3,513,230 | A | 5/1970 | Rhees et al. |
| 3,600,163 | A | 8/1971 | Badia et al. |
| 3,602,305 | A | 8/1971 | Kisling |
| 3,637,446 | A | 1/1972 | Elliott et al. |
| 3,645,331 | A | 2/1972 | Maurer et al. |
| 3,660,049 | A | 5/1972 | Benjamin |
| 3,765,484 | A | 10/1973 | Hamby, Jr. et al. |
| 3,768,563 | A | 10/1973 | Blount |
| 3,775,823 | A | 12/1973 | Adolph et al. |
| 3,816,080 | A | 6/1974 | Bomford et al. |
| 3,878,889 | A | 4/1975 | Seabourn |
| 3,894,850 | A | 7/1975 | Kovalchuk et al. |
| 3,924,677 | A | 12/1975 | Prenner et al. |
| 3,957,483 | A | 5/1976 | Suzuki |
| 4,010,583 | A | 3/1977 | Highberg |
| 4,039,717 | A | 8/1977 | Titus |
| 4,050,529 | A | 9/1977 | Tagirov et al. |
| 4,157,732 | A | 6/1979 | Fonner |

(Continued)

FOREIGN PATENT DOCUMENTS

| | | |
|---|---|---|
| CA | 2783241 A1 | 6/2011 |
| CA | 2783346 A1 | 6/2011 |

(Continued)

OTHER PUBLICATIONS

"Declaration of Karl T. Hartwig in Support of Petitioner Pursuant to 37 C.F.R. § 42.120", executed on Nov. 21, 2016 in support of U.S. Pat. No. 8,573,295, 52 pages.

(Continued)

*Primary Examiner* — Patrick D Niland

(74) *Attorney, Agent, or Firm* — Cantor Colburn LLP

(57) ABSTRACT

A method of manufacturing a dissolvable article comprises forming a liquid-solid mixture comprising secondary particles homogeneously dispersed in a molten metallic matrix material; disposing the liquid-solid mixture in a mold; agitating the liquid-solid mixture in the mold; and molding the liquid-solid mixture under agitation to form a dissolvable article, wherein the secondary particles and the metallic matrix material form a plurality of micro- or nano-sized galvanic cells in the dissolvable article.

21 Claims, 2 Drawing Sheets

(56) References Cited

U.S. PATENT DOCUMENTS 4,248,307 A 2/1981 Silberman et al.
4,284,137 A 8/1981 Taylor
4,292,377 A 9/1981 Petersen et al.
4,372,384 A 2/1983 Kinney
4,373,584 A 2/1983 Silberman et al.
4,373,952 A 2/1983 Parent
4,374,543 A 2/1983 Richardson
4,384,616 A 5/1983 Dellinger
4,395,440 A 7/1983 Abe et al.
4,399,871 A 8/1983 Adkins et al.
4,407,368 A 10/1983 Erbstoesser
4,422,508 A 12/1983 Rutledge, Jr. et al.
4,450,136 A 5/1984 Dudek et al.
4,452,311 A 6/1984 Speegle et al.
4,475,729 A 10/1984 Costigan
4,498,543 A 2/1985 Pye et al.
4,499,048 A 2/1985 Hanejko
4,499,049 A 2/1985 Hanejko
4,524,825 A 6/1985 Fore
4,526,840 A 7/1985 Jerabek
4,534,414 A 8/1985 Pringle
4,539,175 A 9/1985 Lichti et al.
4,554,986 A 11/1985 Jones
4,619,699 A 10/1986 Petkovic-Luton et al.
4,640,354 A 2/1987 Boisson
4,648,901 A 3/1987 Murray et al.
4,664,962 A 5/1987 Desmarais, Jr.
4,668,470 A 5/1987 Gilman et al.
4,673,549 A 6/1987 Ecer
4,674,572 A 6/1987 Gallus
4,678,037 A 7/1987 Smith
4,681,133 A 7/1987 Weston
4,688,641 A 8/1987 Knieriemen
4,690,796 A 9/1987 Paliwal
4,693,863 A 9/1987 Del Corso et al.
4,703,807 A 11/1987 Weston
4,706,753 A 11/1987 Ohkochi et al.
4,708,202 A 11/1987 Sukup et al.
4,708,208 A 11/1987 Halbardier
4,709,761 A 12/1987 Setterberg, Jr.
4,714,116 A 12/1987 Brunner
4,716,964 A 1/1988 Erbstoesser et al.
4,719,971 A 1/1988 Owens
4,721,159 A 1/1988 Ohkochi et al.
4,738,599 A 4/1988 Shilling
4,741,973 A 5/1988 Condit et al.
4,768,588 A 9/1988 Kupsa
4,775,598 A 10/1988 Jaeckel
4,784,226 A 11/1988 Wyatt
4,805,699 A 2/1989 Halbardier
4,817,725 A 4/1989 Jenkins
4,834,184 A 5/1989 Streich et al.
H635 H 6/1989 Johnson et al.
4,850,432 A 7/1989 Porter et al.
4,853,056 A 8/1989 Hoffman
4,869,324 A 9/1989 Holder
4,869,325 A 9/1989 Halbardier
4,880,059 A 11/1989 Brandell et al.
4,889,187 A 12/1989 Terrell et al.
4,890,675 A 1/1990 Dew
4,901,794 A 2/1990 Baugh et al.
4,909,320 A 3/1990 Hebert et al.
4,921,664 A 5/1990 Couper
4,929,415 A 5/1990 Okazaki
4,932,474 A 6/1990 Schroeder, Jr. et al.
4,938,309 A 7/1990 Emdy
4,944,351 A 7/1990 Eriksen et al.
4,949,788 A 8/1990 Szarka et al.
4,952,902 A 8/1990 Kawaguchi et al.
4,975,412 A 12/1990 Okazaki et al.
4,977,958 A 12/1990 Miller
4,981,177 A 1/1991 Carmody et al.
4,986,361 A 1/1991 Mueller et al.
4,997,622 A 3/1991 Regazzoni et al.
5,006,044 A 4/1991 Walker, Sr. et al.
5,010,955 A 4/1991 Springer
5,036,921 A 8/1991 Pittard et al.
5,048,611 A 9/1991 Cochran
5,049,165 A 9/1991 Tselesin
5,061,323 A 10/1991 Deluccia
5,063,775 A 11/1991 Walker, Sr. et al.
5,073,207 A 12/1991 Faure et al.
5,074,361 A 12/1991 Brisco et al.
5,076,869 A 12/1991 Bourell et al.
5,084,088 A 1/1992 Okazaki
5,087,304 A 2/1992 Chang et al.
5,090,480 A 2/1992 Pittard et al.
5,095,988 A 3/1992 Bode
5,103,911 A 4/1992 Heijnen
5,117,915 A 6/1992 Mueller et al.
5,161,614 A 11/1992 Wu et al.
5,171,734 A 12/1992 Sanjurjo et al.
5,178,216 A 1/1993 Giroux et al.
5,181,571 A 1/1993 Mueller et al.
5,183,631 A 2/1993 Kugimiya et al.
5,188,182 A 2/1993 Echols, III et al.
5,188,183 A 2/1993 Hopmann et al.
5,204,055 A 4/1993 Sachs et al.
5,222,867 A 6/1993 Walker, Sr. et al.
5,226,483 A 7/1993 Williamson, Jr.
5,228,518 A 7/1993 Wilson et al.
5,234,055 A 8/1993 Cornette
5,240,742 A * 8/1993 Johnson ..... B22F 1/025 427/216
5,252,365 A 10/1993 White
5,253,714 A 10/1993 Davis et al.
5,271,468 A 12/1993 Streich et al.
5,273,569 A 12/1993 Gilman et al.
5,282,509 A 2/1994 Schurr, III
5,292,478 A 3/1994 Scorey
5,293,940 A 3/1994 Hromas et al.
5,304,260 A 4/1994 Aikawa et al.
5,304,588 A 4/1994 Boysen et al.
5,309,874 A 5/1994 Willermet et al.
5,310,000 A 5/1994 Arterbury et al.
5,316,598 A 5/1994 Chang et al.
5,318,746 A 6/1994 Lashmore
5,352,522 A 10/1994 Kugimiya et al.
5,380,473 A 1/1995 Bogue et al.
5,387,380 A 2/1995 Cima et al.
5,392,860 A 2/1995 Ross
5,394,236 A 2/1995 Murnick
5,394,941 A 3/1995 Venditto et al.
5,398,754 A 3/1995 Dinhoble
5,407,011 A 4/1995 Layton
5,409,555 A 4/1995 Fujita et al.
5,411,082 A 5/1995 Kennedy
5,417,285 A 5/1995 Van Buskirk et al.
5,425,424 A 6/1995 Reinhardt et al.
5,427,177 A 6/1995 Jordan, Jr. et al.
5,435,392 A 7/1995 Kennedy
5,439,051 A 8/1995 Kennedy et al.
5,454,430 A 10/1995 Kennedy et al.
5,456,317 A 10/1995 Hood, III et al.
5,456,327 A 10/1995 Denton et al.
5,464,062 A 11/1995 Blizzard, Jr.
5,472,048 A 12/1995 Kennedy et al.
5,474,131 A 12/1995 Jordan, Jr. et al.
5,477,923 A 12/1995 Jordan, Jr. et al.
5,479,986 A 1/1996 Gano et al.
5,506,055 A 4/1996 Dorfman et al.
5,507,439 A 4/1996 Story
5,511,620 A 4/1996 Baugh et al.
5,524,699 A 6/1996 Cook
5,526,880 A 6/1996 Jordan, Jr. et al.
5,526,881 A 6/1996 Martin et al.
5,529,746 A 6/1996 Knoss et al.
5,533,573 A 7/1996 Jordan, Jr. et al.
5,536,485 A 7/1996 Kume et al.
5,558,153 A 9/1996 Holcombe et al.
5,601,924 A 2/1997 Beane
5,607,017 A 3/1997 Owens et al.
5,623,993 A 4/1997 Van Buskirk et al.
5,623,994 A 4/1997 Robinson

(56) References Cited

U.S. PATENT DOCUMENTS 5,636,691 A 6/1997 Hendrickson et al.
5,641,023 A 6/1997 Ross et al.
5,647,444 A 7/1997 Williams
5,665,289 A 9/1997 Chung et al.
5,677,372 A 10/1997 Yamamoto et al.
5,685,372 A 11/1997 Gano
5,701,576 A 12/1997 Fujita et al.
5,707,214 A 1/1998 Schmidt
5,709,269 A 1/1998 Head
5,720,344 A 2/1998 Newman
5,722,033 A 2/1998 Carden
5,728,195 A 3/1998 Eastman et al.
5,765,639 A 6/1998 Muth
5,772,735 A 6/1998 Sehgal et al.
5,782,305 A 7/1998 Hicks
5,797,454 A 8/1998 Hipp
5,826,652 A 10/1998 Tapp
5,826,661 A 10/1998 Parker et al.
5,829,520 A 11/1998 Johnson
5,836,396 A 11/1998 Norman
5,857,521 A 1/1999 Ross et al.
5,881,816 A 3/1999 Wright
5,896,819 A 4/1999 Turila et al.
5,902,424 A 5/1999 Fujita et al.
5,934,372 A 8/1999 Muth
5,941,309 A 8/1999 Appleton
5,960,881 A 10/1999 Allamon et al.
5,964,965 A 10/1999 Schulz et al.
5,985,466 A 11/1999 Atarashi et al.
5,988,287 A 11/1999 Jordan, Jr. et al.
5,990,051 A 11/1999 Ischy et al.
5,992,452 A 11/1999 Nelson, II
5,992,520 A 11/1999 Schultz et al.
6,007,314 A 12/1999 Nelson, II
6,024,915 A 2/2000 Kume et al.
6,032,735 A 3/2000 Echols
6,036,777 A 3/2000 Sachs
6,047,773 A 4/2000 Zeltmann et al.
6,050,340 A 4/2000 Scott
6,069,313 A 5/2000 Kay
6,076,600 A 6/2000 Vick, Jr. et al.
6,079,496 A 6/2000 Hirth
6,085,837 A 7/2000 Massinon et al.
6,095,247 A 8/2000 Streich et al.
6,119,783 A 9/2000 Parker et al.
6,142,237 A 11/2000 Christmas et al.
6,161,622 A 12/2000 Robb
6,167,970 B1 1/2001 Stout et al.
6,170,583 B1 1/2001 Boyce
6,173,779 B1 1/2001 Smith
6,176,323 B1 1/2001 Weirich et al.
6,189,616 B1 2/2001 Gano et al.
6,189,618 B1 2/2001 Beeman et al.
6,213,202 B1 4/2001 Read, Jr.
6,220,350 B1 4/2001 Brothers et al.
6,220,357 B1 4/2001 Carmichael et al.
6,228,904 B1 5/2001 Yadav et al.
6,237,688 B1 5/2001 Burleson et al.
6,238,280 B1 5/2001 Ritt et al.
6,241,021 B1 6/2001 Bowling
6,248,399 B1 6/2001 Hehmann
6,250,392 B1 6/2001 Muth
6,261,432 B1 7/2001 Huber et al.
6,265,205 B1 7/2001 Hitchens et al.
6,273,187 B1 8/2001 Voisin, Jr. et al.
6,276,452 B1 8/2001 Davis et al.
6,276,457 B1 8/2001 Moffatt et al.
6,279,656 B1 8/2001 Sinclair et al.
6,287,445 B1 9/2001 Lashmore et al.
6,302,205 B1 10/2001 Ryll
6,315,041 B1 11/2001 Carlisle et al.
6,315,050 B2 11/2001 Vaynshteyn et al.
6,325,148 B1 12/2001 Trahan et al.
6,328,110 B1 12/2001 Joubert
6,341,653 B1 1/2002 Firmaniuk et al.
6,341,747 B1 1/2002 Schmidt et al.
6,349,766 B1 2/2002 Bussear et al.
6,354,372 B1 3/2002 Carisella et al.
6,354,379 B2 3/2002 Miszewski et al.
6,357,322 B1 3/2002 Dolan et al.
6,357,332 B1 3/2002 Vecchio
6,371,206 B1 4/2002 Mills
6,372,346 B1 4/2002 Toth
6,382,244 B2 5/2002 Vann
6,390,195 B1 5/2002 Nguyen et al.
6,390,200 B1 5/2002 Allamon et al.
6,394,180 B1 5/2002 Berscheidt et al.
6,394,185 B1 5/2002 Constien
6,397,950 B1 6/2002 Streich et al.
6,401,547 B1 6/2002 Hatfield et al.
6,403,210 B1 6/2002 Stuivinga et al.
6,408,946 B1 6/2002 Marshall et al.
6,419,023 B1 7/2002 George et al.
6,439,313 B1 8/2002 Thomeer et al.
6,446,717 B1 9/2002 White et al.
6,457,525 B1 10/2002 Scott
6,467,546 B2 10/2002 Allamon et al.
6,470,965 B1 10/2002 Winzer
6,491,097 B1 12/2002 Oneal et al.
6,491,116 B2 12/2002 Berscheidt et al.
6,513,598 B2 2/2003 Moore et al.
6,513,600 B2 2/2003 Ross
6,540,033 B1 4/2003 Sullivan et al.
6,543,543 B2 4/2003 Muth
6,561,275 B2 5/2003 Glass et al.
6,588,507 B2 7/2003 Dusterhoft et al.
6,591,915 B2 7/2003 Burris et al.
6,601,648 B2 8/2003 Ebinger
6,601,650 B2 8/2003 Sundararajan
6,609,569 B2 8/2003 Howlett et al.
6,612,826 B1 9/2003 Bauer et al.
6,613,383 B1 9/2003 George et al.
6,619,400 B2 9/2003 Brunet
6,634,428 B2 10/2003 Krauss et al.
6,662,886 B2 12/2003 Russell
6,675,889 B1 1/2004 Mullins et al.
6,699,305 B2 3/2004 Myrick
6,712,153 B2 3/2004 Turley et al.
6,712,797 B1 3/2004 Southern, Jr.
6,713,177 B2 3/2004 George et al.
6,715,541 B2 4/2004 Pedersen et al.
6,719,051 B2 4/2004 Hailey, Jr. et al.
6,755,249 B2 6/2004 Robison et al.
6,769,491 B2 8/2004 Zimmerman et al.
6,776,228 B2 8/2004 Pedersen et al.
6,779,599 B2 8/2004 Mullins et al.
6,799,638 B2 10/2004 Butterfield, Jr.
6,810,960 B2 11/2004 Pia
6,817,414 B2 11/2004 Lee
6,831,044 B2 12/2004 Constien
6,883,611 B2 4/2005 Smith et al.
6,887,297 B2 5/2005 Winter et al.
6,896,049 B2 5/2005 Moyes
6,896,061 B2 5/2005 Hriscu et al.
6,899,176 B2 5/2005 Hailey, Jr. et al.
6,899,777 B2 5/2005 Vaidyanathan et al.
6,908,516 B2 6/2005 Hehmann et al.
6,913,827 B2 7/2005 George et al.
6,926,086 B2 8/2005 Patterson et al.
6,932,159 B2 8/2005 Hovem
6,939,388 B2 9/2005 Angeliu
6,945,331 B2 9/2005 Patel
6,951,331 B2 10/2005 Haughom et al.
6,959,759 B2 11/2005 Doane et al.
6,973,970 B2 12/2005 Johnston et al.
6,973,973 B2 12/2005 Howard et al.
6,983,796 B2 1/2006 Bayne et al.
6,986,390 B2 1/2006 Doane et al.
7,013,989 B2 3/2006 Hammond et al.
7,013,998 B2 3/2006 Ray et al.
7,017,664 B2 3/2006 Walker et al.
7,017,677 B2 3/2006 Keshavan et al.
7,021,389 B2 4/2006 Bishop et al.
7,025,146 B2 4/2006 King et al.

(56) References Cited

U.S. PATENT DOCUMENTS

| | | | |
|---|---|---|---|
| 7,028,778 | B2 | 4/2006 | Krywitsky |
| 7,044,230 | B2 | 5/2006 | Starr et al. |
| 7,049,272 | B2 | 5/2006 | Sinclair et al. |
| 7,051,805 | B2 | 5/2006 | Doane et al. |
| 7,059,410 | B2 | 6/2006 | Bousche et al. |
| 7,090,027 | B1 | 8/2006 | Williams |
| 7,093,664 | B2 | 8/2006 | Todd et al. |
| 7,096,945 | B2 | 8/2006 | Richards et al. |
| 7,096,946 | B2 | 8/2006 | Jasser et al. |
| 7,097,807 | B1 | 8/2006 | Meeks, III et al. |
| 7,097,906 | B2 | 8/2006 | Gardner |
| 7,108,080 | B2 | 9/2006 | Tessari et al. |
| 7,111,682 | B2 | 9/2006 | Blaisdell |
| 7,128,145 | B2 | 10/2006 | Mickey |
| 7,141,207 | B2 | 11/2006 | Jandeska, Jr. et al. |
| 7,150,326 | B2 | 12/2006 | Bishop et al. |
| 7,163,066 | B2 | 1/2007 | Lehr |
| 7,165,622 | B2 | 1/2007 | Hirth et al. |
| 7,168,494 | B2 | 1/2007 | Starr et al. |
| 7,174,963 | B2 | 2/2007 | Bertelsen |
| 7,182,135 | B2 | 2/2007 | Szarka |
| 7,188,559 | B1 | 3/2007 | Vecchio |
| 7,210,527 | B2 | 5/2007 | Walker et al. |
| 7,210,533 | B2 | 5/2007 | Starr et al. |
| 7,217,311 | B2 | 5/2007 | Hong et al. |
| 7,234,530 | B2 | 6/2007 | Gass |
| 7,250,188 | B2 | 7/2007 | Dodelet et al. |
| 7,252,162 | B2 | 8/2007 | Akinlade et al. |
| 7,255,172 | B2 | 8/2007 | Johnson |
| 7,255,178 | B2 | 8/2007 | Slup et al. |
| 7,264,060 | B2 | 9/2007 | Wills |
| 7,267,172 | B2 | 9/2007 | Hofman |
| 7,267,178 | B2 | 9/2007 | Krywitsky |
| 7,270,186 | B2 | 9/2007 | Johnson |
| 7,287,592 | B2 | 10/2007 | Surjaatmadja et al. |
| 7,311,152 | B2 | 12/2007 | Howard et al. |
| 7,316,274 | B2 | 1/2008 | Xu et al. |
| 7,320,365 | B2 | 1/2008 | Pia |
| 7,322,412 | B2 | 1/2008 | Badalamenti et al. |
| 7,322,417 | B2 | 1/2008 | Rytlewski et al. |
| 7,325,617 | B2 | 2/2008 | Murray |
| 7,328,750 | B2 | 2/2008 | Swor et al. |
| 7,331,388 | B2 | 2/2008 | Vilela et al. |
| 7,337,854 | B2 | 3/2008 | Horn et al. |
| 7,346,456 | B2 | 3/2008 | Le Bemadjiel |
| 7,350,582 | B2 | 4/2008 | McKeachnie et al. |
| 7,353,879 | B2 | 4/2008 | Todd et al. |
| 7,360,593 | B2 | 4/2008 | Constien |
| 7,360,597 | B2 | 4/2008 | Blaisdell |
| 7,363,970 | B2 | 4/2008 | Corre et al. |
| 7,373,978 | B2 | 5/2008 | Barry et al. |
| 7,384,443 | B2 | 6/2008 | Mirchandani |
| 7,387,158 | B2 | 6/2008 | Murray et al. |
| 7,387,165 | B2 | 6/2008 | Lopez De Cardenas et al. |
| 7,392,841 | B2 | 7/2008 | Murray et al. |
| 7,401,648 | B2 | 7/2008 | Bennett |
| 7,416,029 | B2 | 8/2008 | Telfer et al. |
| 7,422,058 | B2 | 9/2008 | O'Malley |
| 7,426,964 | B2 | 9/2008 | Lynde et al. |
| 7,441,596 | B2 | 10/2008 | Wood et al. |
| 7,445,049 | B2 | 11/2008 | Howard et al. |
| 7,451,815 | B2 | 11/2008 | Hailey, Jr. |
| 7,451,817 | B2 | 11/2008 | Reddy et al. |
| 7,461,699 | B2 | 12/2008 | Richard et al. |
| 7,464,764 | B2 | 12/2008 | Xu |
| 7,472,750 | B2 | 1/2009 | Walker et al. |
| 7,478,676 | B2 | 1/2009 | East, Jr. et al. |
| 7,503,390 | B2 | 3/2009 | Gomez |
| 7,503,399 | B2 | 3/2009 | Badalamenti et al. |
| 7,509,993 | B1 | 3/2009 | Turng et al. |
| 7,510,018 | B2 | 3/2009 | Williamson et al. |
| 7,513,311 | B2 | 4/2009 | Gramstad et al. |
| 7,527,103 | B2 | 5/2009 | Huang et al. |
| 7,537,825 | B1 | 5/2009 | Wardle et al. |
| 7,552,777 | B2 | 6/2009 | Murray et al. |
| 7,552,779 | B2 | 6/2009 | Murray |
| 7,559,357 | B2 | 7/2009 | Clem |
| 7,575,062 | B2 | 8/2009 | East, Jr. |
| 7,579,087 | B2 | 8/2009 | Maloney et al. |
| 7,591,318 | B2 | 9/2009 | Tilghman |
| 7,600,572 | B2 | 10/2009 | Slup et al. |
| 7,604,049 | B2 | 10/2009 | Vaidya et al. |
| 7,604,055 | B2 | 10/2009 | Richard et al. |
| 7,607,476 | B2 | 10/2009 | Tom et al. |
| 7,617,871 | B2 | 11/2009 | Surjaatmadja et al. |
| 7,635,023 | B2 | 12/2009 | Goldberg et al. |
| 7,640,988 | B2 | 1/2010 | Phi et al. |
| 7,661,480 | B2 | 2/2010 | Al-Anazi |
| 7,661,481 | B2 | 2/2010 | Todd et al. |
| 7,665,537 | B2 | 2/2010 | Patel et al. |
| 7,686,082 | B2 | 3/2010 | Marsh |
| 7,690,436 | B2 | 4/2010 | Turley et al. |
| 7,699,101 | B2 | 4/2010 | Fripp et al. |
| 7,703,510 | B2 | 4/2010 | Xu |
| 7,703,511 | B2 | 4/2010 | Buyers et al. |
| 7,708,078 | B2 | 5/2010 | Stoesz |
| 7,709,421 | B2 | 5/2010 | Jones et al. |
| 7,712,541 | B2 | 5/2010 | Loretz et al. |
| 7,723,272 | B2 | 5/2010 | Crews et al. |
| 7,726,406 | B2 | 6/2010 | Xu |
| 7,735,578 | B2 | 6/2010 | Loehr et al. |
| 7,743,836 | B2 | 6/2010 | Cook et al. |
| 7,752,971 | B2 | 7/2010 | Loehr |
| 7,757,773 | B2 | 7/2010 | Rytlewski |
| 7,762,342 | B2 | 7/2010 | Richard et al. |
| 7,770,652 | B2 | 8/2010 | Barnett |
| 7,771,289 | B2 | 8/2010 | Palumbo et al. |
| 7,775,284 | B2 | 8/2010 | Richards et al. |
| 7,775,285 | B2 | 8/2010 | Surjaatmadja et al. |
| 7,775,286 | B2 | 8/2010 | Duphorne |
| 7,784,543 | B2 | 8/2010 | Johnson |
| 7,793,714 | B2 | 9/2010 | Johnson |
| 7,793,820 | B2 | 9/2010 | Hirano et al. |
| 7,798,225 | B2 | 9/2010 | Giroux et al. |
| 7,798,226 | B2 | 9/2010 | Themig |
| 7,798,236 | B2 | 9/2010 | McKeachnie et al. |
| 7,806,189 | B2 | 10/2010 | Frazier |
| 7,806,192 | B2 | 10/2010 | Foster et al. |
| 7,810,553 | B2 | 10/2010 | Cruickshank et al. |
| 7,810,567 | B2 | 10/2010 | Daniels et al. |
| 7,819,198 | B2 | 10/2010 | Birckhead et al. |
| 7,828,055 | B2 | 11/2010 | Willauer et al. |
| 7,833,944 | B2 | 11/2010 | Munoz et al. |
| 7,849,927 | B2 | 12/2010 | Herrera |
| 7,851,016 | B2 | 12/2010 | Arbab et al. |
| 7,855,168 | B2 | 12/2010 | Fuller et al. |
| 7,861,779 | B2 | 1/2011 | Vestavik |
| 7,861,781 | B2 | 1/2011 | D'Arcy |
| 7,874,365 | B2 | 1/2011 | East, Jr. et al. |
| 7,878,253 | B2 | 2/2011 | Stowe et al. |
| 7,879,367 | B2 | 2/2011 | Heublein et al. |
| 7,896,091 | B2 | 3/2011 | Williamson et al. |
| 7,897,063 | B1 | 3/2011 | Perry et al. |
| 7,900,696 | B1 | 3/2011 | Nish et al. |
| 7,900,703 | B2 | 3/2011 | Clark et al. |
| 7,909,096 | B2 | 3/2011 | Clark et al. |
| 7,909,104 | B2 | 3/2011 | Bjorgum |
| 7,909,110 | B2 | 3/2011 | Sharma et al. |
| 7,909,115 | B2 | 3/2011 | Grove et al. |
| 7,913,765 | B2 | 3/2011 | Crow et al. |
| 7,918,275 | B2 | 4/2011 | Clem |
| 7,931,093 | B2 | 4/2011 | Foster et al. |
| 7,938,191 | B2 | 5/2011 | Vaidya |
| 7,946,335 | B2 | 5/2011 | Bewlay et al. |
| 7,946,340 | B2 | 5/2011 | Surjaatmadja et al. |
| 7,958,940 | B2 | 6/2011 | Jameson |
| 7,963,331 | B2 | 6/2011 | Surjaatmadja et al. |
| 7,963,340 | B2 | 6/2011 | Gramstad et al. |
| 7,963,342 | B2 | 6/2011 | George |
| 7,980,300 | B2 | 7/2011 | Roberts et al. |
| 7,987,906 | B1 | 8/2011 | Troy |
| 7,992,763 | B2 | 8/2011 | Vecchio et al. |
| 8,020,619 | B1 | 9/2011 | Robertson et al. |
| 8,020,620 | B2 | 9/2011 | Daniels et al. |

(56) References Cited

U.S. PATENT DOCUMENTS 8,025,104 B2 9/2011 Cooke, Jr.
8,028,767 B2 10/2011 Radford et al.
8,033,331 B2 10/2011 Themig
8,039,422 B1 10/2011 Al-Zahrani
8,056,628 B2 11/2011 Whitsitt et al.
8,056,638 B2 11/2011 Clayton et al.
8,109,340 B2 2/2012 Doane et al.
8,127,856 B1 3/2012 Nish et al.
8,153,052 B2 4/2012 Jackson et al.
8,163,060 B2 4/2012 Imanishi et al.
8,211,247 B2 7/2012 Marya et al.
8,211,248 B2 7/2012 Marya
8,220,554 B2 7/2012 Jordan et al.
8,226,740 B2 7/2012 Chaumonnot et al.
8,230,731 B2 7/2012 Dyer et al.
8,231,947 B2 7/2012 Vaidya et al.
8,263,178 B2 9/2012 Boulos et al.
8,276,670 B2 10/2012 Patel
8,277,974 B2 10/2012 Kumar et al.
8,297,364 B2 10/2012 Agrawal et al.
8,327,931 B2 12/2012 Agrawal et al.
8,403,037 B2 3/2013 Agrawal et al.
8,413,727 B2 4/2013 Holmes
8,425,651 B2 * 4/2013 Xu ..... B22F 1/025 75/245
8,459,347 B2 6/2013 Stout
8,486,329 B2 7/2013 Shikai et al.
8,490,674 B2 7/2013 Stevens et al.
8,490,689 B1 7/2013 McClinton et al.
8,535,604 B1 9/2013 Baker et al.
8,573,295 B2 11/2013 Johnson et al.
8,631,876 B2 1/2014 Xu et al.
8,663,401 B2 3/2014 Marya et al.
8,734,602 B2 5/2014 Li et al.
8,770,261 B2 7/2014 Marya
8,956,660 B2 2/2015 Launag et al.
8,978,734 B2 3/2015 Stevens
8,998,978 B2 4/2015 Wang
9,057,242 B2 6/2015 Mazyar et al.
9,079,246 B2 7/2015 Xu et al.
9,080,098 B2 7/2015 Xu et al.
9,089,408 B2 7/2015 Xu
9,260,935 B2 2/2016 Murphree et al.
10,016,810 B2 * 7/2018 Salinas ..... B22D 18/06
2001/0040180 A1 11/2001 Wittebrood et al.
2001/0045285 A1 11/2001 Russell
2001/0045288 A1 11/2001 Allamon et al.
2002/0000319 A1 1/2002 Brunet
2002/0007948 A1 1/2002 Bayne et al.
2002/0014268 A1 2/2002 Vann
2002/0020527 A1 2/2002 Kilaas et al.
2002/0066572 A1 6/2002 Muth
2002/0092654 A1 7/2002 Coronado et al.
2002/0096365 A1 7/2002 Berscheidt et al.
2002/0104616 A1 8/2002 De et al.
2002/0108756 A1 8/2002 Harrall et al.
2002/0136904 A1 9/2002 Glass et al.
2002/0139541 A1 10/2002 Sheffield et al.
2002/0162661 A1 11/2002 Krauss et al.
2003/0019639 A1 1/2003 MacKay
2003/0037925 A1 2/2003 Walker et al.
2003/0060374 A1 3/2003 Cooke, Jr.
2003/0075326 A1 4/2003 Ebinger
2003/0104147 A1 6/2003 Bretschneider et al.
2003/0111728 A1 6/2003 Thai et al.
2003/0127013 A1 7/2003 Zavitsanos et al.
2003/0141060 A1 7/2003 Hailey et al.
2003/0141061 A1 7/2003 Hailey et al.
2003/0141079 A1 7/2003 Doane et al.
2003/0150614 A1 8/2003 Brown et al.
2003/0155114 A1 8/2003 Pedersen et al.
2003/0155115 A1 8/2003 Pedersen et al.
2003/0159828 A1 8/2003 Howard et al.
2003/0164237 A1 9/2003 Butterfield
2003/0183391 A1 10/2003 Hriscu et al.
2003/0226668 A1 12/2003 Zimmerman et al.
2004/0005483 A1 1/2004 Lin
2004/0020832 A1 2/2004 Richards et al.
2004/0031605 A1 2/2004 Mickey
2004/0045723 A1 3/2004 Slup et al.
2004/0055758 A1 3/2004 Brezinski et al.
2004/0058167 A1 3/2004 Arbab et al.
2004/0069502 A1 4/2004 Luke
2004/0089449 A1 5/2004 Walton et al.
2004/0094297 A1 5/2004 Malone et al.
2004/0154806 A1 8/2004 Bode et al.
2004/0159428 A1 8/2004 Hammond et al.
2004/0159446 A1 8/2004 Haugen et al.
2004/0182583 A1 9/2004 Doane et al.
2004/0216868 A1 11/2004 Owen, Sr.
2004/0231845 A1 11/2004 Cooke, Jr.
2004/0251025 A1 12/2004 Giroux et al.
2004/0256109 A1 12/2004 Johnson
2004/0256157 A1 12/2004 Tessari et al.
2004/0261993 A1 12/2004 Nguyen
2004/0261994 A1 12/2004 Nguyen et al.
2005/0034876 A1 2/2005 Doane et al.
2005/0051329 A1 3/2005 Blaisdell
2005/0064247 A1 3/2005 Sane
2005/0069449 A1 3/2005 Jackson et al.
2005/0074612 A1 4/2005 Eklund et al.
2005/0098313 A1 5/2005 Atkins et al.
2005/0102255 A1 5/2005 Bultman
2005/0106316 A1 5/2005 Rigney et al.
2005/0126334 A1 6/2005 Mirchandani
2005/0161212 A1 7/2005 Leismer et al.
2005/0161224 A1 7/2005 Starr et al.
2005/0165149 A1 7/2005 Chanak et al.
2005/0194143 A1 9/2005 Xu et al.
2005/0199401 A1 9/2005 Patel et al.
2005/0205264 A1 9/2005 Starr et al.
2005/0205265 A1 9/2005 Todd et al.
2005/0205266 A1 9/2005 Todd et al.
2005/0235757 A1 10/2005 De Jonge et al.
2005/0241824 A1 11/2005 Burris, II et al.
2005/0241825 A1 11/2005 Burris, II et al.
2005/0257936 A1 11/2005 Lehr
2005/0268746 A1 12/2005 Abkowitz et al.
2005/0269097 A1 12/2005 Towler
2005/0275143 A1 12/2005 Toth
2005/0279501 A1 12/2005 Surjaatmadja et al.
2006/0012087 A1 1/2006 Matsuda et al.
2006/0013350 A1 1/2006 Akers
2006/0045787 A1 3/2006 Jandeska et al.
2006/0057479 A1 3/2006 Niimi et al.
2006/0081378 A1 4/2006 Howard et al.
2006/0102871 A1 5/2006 Wang
2006/0108114 A1 5/2006 Johnson et al.
2006/0108126 A1 5/2006 Horn et al.
2006/0110615 A1 5/2006 Karim et al.
2006/0116696 A1 6/2006 Odermatt et al.
2006/0124310 A1 6/2006 Lopez De Cardenas et al.
2006/0131011 A1 6/2006 Lynde et al.
2006/0131031 A1 6/2006 McKeachnie et al.
2006/0131081 A1 6/2006 Mirchandani et al.
2006/0134312 A1 6/2006 Rytlewski et al.
2006/0144515 A1 7/2006 Tada et al.
2006/0150770 A1 7/2006 Freim
2006/0151178 A1 7/2006 Howard et al.
2006/0153728 A1 7/2006 Schoenung et al.
2006/0162927 A1 7/2006 Walker et al.
2006/0169453 A1 8/2006 Savery et al.
2006/0186602 A1 8/2006 Martin et al.
2006/0207763 A1 9/2006 Hofman et al.
2006/0213670 A1 9/2006 Bishop et al.
2006/0231253 A1 10/2006 Vilela et al.
2006/0269437 A1 11/2006 Pandey
2006/0283592 A1 12/2006 Sierra et al.
2007/0017674 A1 1/2007 Blaisdell
2007/0017675 A1 1/2007 Hammami
2007/0029082 A1 2/2007 Giroux et al.
2007/0039161 A1 2/2007 Garcia
2007/0039741 A1 2/2007 Hailey
2007/0044958 A1 3/2007 Rytlewski et al.

(56) References Cited

U.S. PATENT DOCUMENTS

2007/0044966 A1 3/2007 Davies et al.
2007/0051521 A1 3/2007 Fike et al.
2007/0053785 A1 3/2007 Hetz et al.
2007/0054101 A1 3/2007 Sigalas et al.
2007/0057415 A1 3/2007 Katagiri et al.
2007/0062644 A1 3/2007 Nakamura et al.
2007/0074601 A1 4/2007 Hong et al.
2007/0074873 A1 4/2007 McKeachnie et al.
2007/0102199 A1 5/2007 Smith et al.
2007/0107899 A1 5/2007 Werner et al.
2007/0107908 A1 5/2007 Vaidya et al.
2007/0108060 A1 5/2007 Park
2007/0119600 A1 5/2007 Slup et al.
2007/0131912 A1 6/2007 Simone et al.
2007/0151009 A1 7/2007 Conrad, III et al.
2007/0151769 A1 7/2007 Slutz et al.
2007/0169935 A1 7/2007 Akbar et al.
2007/0181224 A1 8/2007 Marya et al.
2007/0185655 A1 8/2007 Le Bemadjiel
2007/0187095 A1 8/2007 Walker et al.
2007/0207182 A1 9/2007 Weber et al.
2007/0221373 A1 9/2007 Murray
2007/0221384 A1 9/2007 Murray
2007/0227745 A1 10/2007 Roberts et al.
2007/0259994 A1 11/2007 Tour et al.
2007/0261862 A1 11/2007 Murray
2007/0272411 A1 11/2007 Lopez De Cardenas et al.
2007/0272413 A1 11/2007 Rytlewski et al.
2007/0277979 A1 12/2007 Todd et al.
2007/0284109 A1 12/2007 East et al.
2007/0284112 A1 12/2007 Magne et al.
2007/0299510 A1 12/2007 Venkatraman et al.
2008/0011473 A1 1/2008 Wood et al.
2008/0020923 A1 1/2008 Debe et al.
2008/0047707 A1 2/2008 Boney et al.
2008/0060810 A9 3/2008 Nguyen et al.
2008/0066923 A1 3/2008 Xu
2008/0066924 A1 3/2008 Xu
2008/0072705 A1 3/2008 Chaumonnot et al.
2008/0078553 A1 4/2008 George
2008/0081866 A1 4/2008 Gong et al.
2008/0093073 A1 4/2008 Bustos et al.
2008/0099209 A1 5/2008 Loretz et al.
2008/0105438 A1 5/2008 Jordan et al.
2008/0115932 A1 5/2008 Cooke
2008/0121390 A1 5/2008 O'Malley et al.
2008/0121436 A1 5/2008 Slay et al.
2008/0127475 A1 6/2008 Griffo
2008/0135249 A1 6/2008 Fripp et al.
2008/0149325 A1 6/2008 Crawford
2008/0149345 A1 6/2008 Bicerano
2008/0149351 A1 6/2008 Marya et al.
2008/0169105 A1 7/2008 Williamson et al.
2008/0169130 A1 7/2008 Norman et al.
2008/0179060 A1 7/2008 Surjaatmadja et al.
2008/0179104 A1 7/2008 Zhang et al.
2008/0196801 A1 8/2008 Zhao et al.
2008/0202764 A1 8/2008 Clayton et al.
2008/0202814 A1 8/2008 Lyons et al.
2008/0210473 A1 9/2008 Zhang et al.
2008/0216383 A1 9/2008 Pierick et al.
2008/0223586 A1 9/2008 Barnett
2008/0223587 A1 9/2008 Cherewyk
2008/0236829 A1 10/2008 Lynde
2008/0236842 A1 10/2008 Bhavsar et al.
2008/0248205 A1 10/2008 Blanchet et al.
2008/0248413 A1 10/2008 Ishii et al.
2008/0264594 A1 10/2008 Lohmueller et al.
2008/0277109 A1 11/2008 Vaidya
2008/0277980 A1 11/2008 Koda et al.
2008/0282924 A1 11/2008 Saenger et al.
2008/0296024 A1 12/2008 Tianping et al.
2008/0302538 A1 12/2008 Hofman
2008/0314581 A1 12/2008 Brown
2008/0314588 A1 12/2008 Langlais et al.
2009/0038858 A1 2/2009 Griffo et al.
2009/0044946 A1 2/2009 Schasteen et al.
2009/0044949 A1 2/2009 King et al.
2009/0050334 A1 2/2009 Marya et al.
2009/0056934 A1 3/2009 Xu
2009/0065216 A1 3/2009 Frazier
2009/0074603 A1 3/2009 Chan et al.
2009/0084553 A1 4/2009 Rytlewski et al.
2009/0084556 A1 4/2009 Richards et al.
2009/0084600 A1 4/2009 Severance
2009/0090440 A1 4/2009 Kellett et al.
2009/0107684 A1 4/2009 Cooke, Jr.
2009/0114381 A1 5/2009 Stroobants
2009/0114382 A1 5/2009 Grove et al.
2009/0126436 A1 5/2009 Fly et al.
2009/0139720 A1 6/2009 Frazier
2009/0145666 A1 6/2009 Radford et al.
2009/0151949 A1 6/2009 Marya et al.
2009/0152009 A1 6/2009 Slay et al.
2009/0155616 A1 6/2009 Thamida et al.
2009/0159289 A1 6/2009 Avant et al.
2009/0178808 A1 7/2009 Williamson et al.
2009/0194273 A1 8/2009 Surjaatmadja et al.
2009/0194745 A1* 8/2009 Tanaka ..... B23K 35/262
252/514
2009/0205841 A1 8/2009 Kluge et al.
2009/0211770 A1 8/2009 Nutley et al.
2009/0226340 A1 9/2009 Marya
2009/0226704 A1 9/2009 Kauppinen et al.
2009/0242202 A1 10/2009 Rispler et al.
2009/0242208 A1 10/2009 Bolding
2009/0242214 A1 10/2009 Foster et al.
2009/0255667 A1 10/2009 Clem et al.
2009/0255684 A1 10/2009 Bolding
2009/0255686 A1 10/2009 Richard
2009/0266548 A1 10/2009 Olsen et al.
2009/0260817 A1 11/2009 Gambier et al.
2009/0272544 A1 11/2009 Giroux et al.
2009/0283270 A1 11/2009 Langeslag
2009/0293672 A1 12/2009 Mirchandani et al.
2009/0301730 A1 12/2009 Gweily
2009/0305131 A1 12/2009 Kumar et al.
2009/0308588 A1 12/2009 Howell et al.
2009/0317556 A1 12/2009 Macary
2009/0317622 A1 12/2009 Huang et al.
2010/0003536 A1 1/2010 Smith et al.
2010/0012385 A1 1/2010 Drivdahl et al.
2010/0015002 A1 1/2010 Barrera et al.
2010/0015469 A1 1/2010 Romanowski et al.
2010/0025255 A1 2/2010 Su et al.
2010/0032151 A1 2/2010 Duphorne et al.
2010/0034857 A1 2/2010 Launag et al.
2010/0038076 A1 2/2010 Spray et al.
2010/0038595 A1 2/2010 Imholt et al.
2010/0040180 A1 2/2010 Kim et al.
2010/0044041 A1 2/2010 Smith et al.
2010/0051278 A1 3/2010 Mytopher et al.
2010/0055491 A1 3/2010 Vecchio et al.
2010/0055492 A1 3/2010 Barsoum et al.
2010/0089583 A1 4/2010 Xu et al.
2010/0089587 A1 4/2010 Stout
2010/0101803 A1 4/2010 Clayton et al.
2010/0116495 A1 5/2010 Spray
2010/0122817 A1 5/2010 Surjaatmadja et al.
2010/0139930 A1 6/2010 Patel et al.
2010/0200230 A1 8/2010 East, Jr. et al.
2010/0209288 A1 8/2010 Marya
2010/0236793 A1 9/2010 Bjorgum
2010/0236794 A1 9/2010 Duan et al.
2010/0243254 A1 9/2010 Murphy et al.
2010/0252273 A1 10/2010 Duphorne
2010/0252280 A1 10/2010 Swor et al.
2010/0270031 A1 10/2010 Patel
2010/0276136 A1 11/2010 Evans et al.
2010/0276159 A1 11/2010 Mailand et al.
2010/0282338 A1 11/2010 Gerrard et al.
2010/0282469 A1 11/2010 Richard et al.
2010/0294510 A1 11/2010 Holmes
2010/0297432 A1 11/2010 Sherman et al.

(56) References Cited

U.S. PATENT DOCUMENTS

2010/0304182 A1 12/2010 Facchini et al.
2010/0314105 A1 12/2010 Rose
2010/0314126 A1 12/2010 Kellner
2010/0319870 A1 12/2010 Bewlay et al.
2010/0326650 A1 12/2010 Tran et al.
2011/0005773 A1 1/2011 Dusterhoft et al.
2011/0036592 A1 2/2011 Fay
2011/0048743 A1 3/2011 Stafford et al.
2011/0052805 A1 3/2011 Bordere et al.
2011/0056692 A1 3/2011 Lopez De Cardenas et al.
2011/0056702 A1 3/2011 Sharma et al.
2011/0067872 A1 3/2011 Agrawal
2011/0067889 A1 3/2011 Marya et al.
2011/0067890 A1 3/2011 Themig
2011/0094406 A1 4/2011 Marya et al.
2011/0100643 A1 5/2011 Themig et al.
2011/0127044 A1 6/2011 Radford et al.
2011/0132143 A1 6/2011 Xu et al.
2011/0132612 A1 6/2011 Agrawal et al.
2011/0132619 A1 6/2011 Agrawal et al.
2011/0132620 A1 6/2011 Agrawal et al.
2011/0132621 A1 6/2011 Agrawal et al.
2011/0135530 A1 6/2011 Xu et al.
2011/0135805 A1 6/2011 Doucet et al.
2011/0135953 A1 6/2011 Xu et al.
2011/0136707 A1 6/2011 Xu et al.
2011/0139465 A1 6/2011 Tibbles et al.
2011/0147014 A1 6/2011 Chen et al.
2011/0186306 A1 8/2011 Marya et al.
2011/0214881 A1 9/2011 Newton
2011/0247833 A1 10/2011 Todd et al.
2011/0253387 A1 10/2011 Ervin
2011/0256356 A1 10/2011 Tomantschger et al.
2011/0259610 A1 10/2011 Shkurti et al.
2011/0277987 A1 11/2011 Frazier
2011/0277989 A1 11/2011 Frazier
2011/0284232 A1 11/2011 Huang
2011/0284240 A1 11/2011 Chen et al.
2011/0284243 A1 11/2011 Frazier
2011/0300403 A1 12/2011 Vecchio et al.
2011/0314881 A1 12/2011 Hatcher et al.
2012/0046732 A1 2/2012 Sillekens et al.
2012/0067426 A1 3/2012 Soni et al.
2012/0090839 A1 4/2012 Rudic
2012/0103135 A1 5/2012 Xu et al.
2012/0107590 A1 5/2012 Xu et al.
2012/0118583 A1 5/2012 Johnson et al.
2012/0130470 A1 5/2012 Agnew
2012/0145378 A1 6/2012 Frazier et al.
2012/0145389 A1 6/2012 Fitzpatrick, Jr.
2012/0168152 A1 7/2012 Casciaro et al.
2012/0177905 A1 7/2012 Seals et al.
2012/0205120 A1 8/2012 Howell
2012/0205872 A1 8/2012 Reinhardt et al.
2012/0211239 A1 8/2012 Kritzler et al.
2012/0234546 A1 9/2012 Xu et al.
2012/0234547 A1 9/2012 O'Malley et al.
2012/0267101 A1 10/2012 Cooke
2012/0269673 A1 10/2012 Koo et al.
2012/0292053 A1 11/2012 Xu et al.
2012/0318513 A1 12/2012 Mazyar et al.
2013/0004847 A1 1/2013 Kumar et al.
2013/0008671 A1 1/2013 Booth et al.
2013/0025409 A1 1/2013 Xu
2013/0029886 A1 1/2013 Mazyar et al.
2013/0032357 A1 2/2013 Mazyar et al.
2013/0048304 A1 2/2013 Agrawal et al.
2013/0048305 A1 2/2013 Xu et al.
2013/0052472 A1 2/2013 Xu
2013/0081814 A1 4/2013 Gaudette et al.
2013/0084643 A1 4/2013 Commarieu et al.
2013/0105159 A1 5/2013 Alvarez
2013/0126190 A1 5/2013 Mazyar et al.
2013/0133897 A1 5/2013 Baihly et al.
2013/0144290 A1 6/2013 Schiffl et al.
2013/0146144 A1 6/2013 Joseph et al.
2013/0146302 A1 6/2013 Gaudette et al.
2013/0167502 A1* 7/2013 Wilson ..... B29C 70/025 57/210
2013/0168257 A1 7/2013 Mazyar et al.
2013/0186626 A1 7/2013 Aitken et al.
2013/0240200 A1 9/2013 Frazier
2013/0240203 A1 9/2013 Frazier
2013/0299185 A1 11/2013 Xu et al.
2013/0299192 A1 11/2013 Xu et al.
2013/0300066 A1 11/2013 Xu et al.
2013/0319668 A1 12/2013 Tschetter et al.
2013/0327540 A1 12/2013 Hamid et al.
2014/0014339 A1 1/2014 O'Malley et al.
2014/0027128 A1 1/2014 Johnson et al.
2014/0060834 A1 3/2014 Quintero et al.
2014/0116711 A1 5/2014 Tang et al.
2014/0186207 A1 7/2014 Bae et al.
2014/0190705 A1 7/2014 Fripp et al.
2014/0196899 A1 7/2014 Jordan et al.
2014/0262327 A1 9/2014 Xu et al.
2014/0360728 A1 12/2014 Tashiro et al.
2015/0060085 A1 3/2015 Xu
2015/0065401 A1 3/2015 Xu et al.
2015/0240337 A1 8/2015 Sherman et al.
2015/0299838 A1 10/2015 Doud et al.
2016/0209391 A1 7/2016 Zhang et al.
2016/0258242 A1 9/2016 Hayter et al.
2017/0165745 A1 6/2017 Salinas et al.

FOREIGN PATENT DOCUMENTS

CN 1076968 A 10/1993
CN 1079234 A 12/1993
CN 1255879 A 6/2000
CN 2658384 Y 11/2004
CN 1668545 A 9/2005
CN 101050417 A 10/2007
CN 101351523 A 1/2009
CN 101454074 A 6/2009
CN 101457321 A 6/2009
CN 101605963 12/2009
CN 101720378 A 6/2010
EP 0033625 A1 8/1981
EP 1174385 A2 1/2002
EP 1412175 A1 4/2004
EP 1798301 A1 8/2006
EP 1857570 A2 11/2007
FR 2782096 A1 2/2000
GB 912956 A 12/1962
GB 1046330 A 10/1966
GB 1280833 A 7/1972
GB 1357065 A 6/1974
JP 61067770 A 4/1986
JP 754008 A 2/1995
JP 8232029 A 9/1996
JP 2000185725 A1 7/2000
JP 2002053902 A 2/2002
JP 2004225084 A 8/2004
JP 2004225765 A 8/2004
JP 2005076052 A 3/2005
JP 2010502840 A 1/2010
KR 950014350 B1 11/1995
WO 9909227 A1 2/1999
WO 9947726 A1 9/1999
WO 2004001087 A1 12/2003
WO 2004073889 A1 9/2004
WO 2005040068 A 5/2005
WO 2007044635 A 4/2007
WO 2007095376 A2 8/2007
WO 2008034042 A3 3/2008
WO 2008057045 A1 5/2008
WO 2008079485 A2 7/2008
WO 2008079777 A2 7/2008
WO 2009079745 A1 7/2009
WO 2010012184 A1 2/2010
WO 2010083826 7/2010
WO 2011071902 A2 6/2011
WO 2011071907 A2 6/2011

(56) References Cited

FOREIGN PATENT DOCUMENTS

| | | | |
|---|---|---|---|
| WO | 2011071910 | A2 | 6/2011 |
| WO | 2011130063 | A3 | 2/2012 |
| WO | 2012015567 | A2 | 2/2012 |
| WO | 2012149007 | A2 | 11/2012 |
| WO | 2012174101 | A2 | 12/2012 |
| WO | 2013053057 | A1 | 4/2013 |
| WO | 2013078031 | A1 | 5/2013 |
| WO | 2014121384 | A1 | 8/2014 |
| WO | 2016085798 | | 6/2016 |

OTHER PUBLICATIONS

"Declaration of Karl T. Hartwig in Support of Petitioner Pursuant to 37 C.F.R. § 42.120", executed on Nov. 21, 2016 in support of U.S. Pat. No. 9,101,978, 51 pages.
Callister, Jr., William D., Materials Science and Engineering an Introduction, Seventh Edition, 2006, pp. 111, 627, and G7.
German, Randall M., Powder Metallurgy Science, Second Edition, 1994, 102 pages.
Klar, Erhard, ASM Handbook: International Metals Handbook—Powder Metallurgy, vol. 7, 1997, pp. 14, 276, and 798.
Petition for Inter Partes Review; Case No. IPR2017-00326; U.S. Pat. No. 9,101,978; Nov. 23, 2016; 46 pages.
Petition for Inter Partes Review; Case No. IPR2017-00327; U.S. Pat. No. 8,573,295; Nov. 23, 2016; 53 pages.
Schaffer, James P. et al., The Science and Design of Engineering Materials, Second Edition, 1999, pp. 122, 123, 098, and 699.
Xie, Guoqiang et al., "TEM Observation of Interfaces between Particles in Al—Mg Alloy Powder Compacts Prepared by Pulse Electric Current Sintering", Materials Transactions, 2002, pp. 2177-2180, vol. 43—No. 9.
"Baker Hughes Refines Expandable Tubular Technology with Abaqus and Insight", Simulia Realistic Simulation News, Jan./Feb. 2011, pp. 12-13.
"Reactivity series", Wikipedia, http://en.wikipedia.org/w/index.php?title=Reactivity_series&printable=yes downloaded on May 18, 2014. 8 pages.
Bakshi et al., "Carbon nanotube reinforced metal matrix composites—a review," International Materials Reviews; 2010, pp. 41-64, vol. 55, No. 1.
Birbilis, et al., "Exploring Corrosion Protection of Mg Via Ionic Liquid Pretreatment", Surface & Coatings Technology; 201, pp. 4496-4504, (2007).
Feng, et al., "Electroless Plating of Carbon Nanotubes with Silver" Journal of Materials Science, 39, (2004) pp. 3241-3243.
Lee, et al., "Effects of Ni addition on hydrogen storage properties of Mg17Al12 alloy", Materials Chemistry and Physics, 2011, 126, pp. 319-324.
Li, et al., "Investigation of aluminium-based nanocomposites with ultra-high strength", Materials Science and Engineering A, 527, pp. 305-316, (2009).
Liu, et al.; "Electroless Nickel Plating on AZ91 Mg Alloy Substrate"; Surface & Coatings Technology; 200; pp. 5087-5093; (2006).
Mathis, "Sand Management: A Review of Approaches and Concerns", Society of Petroleum Engineers, SPE Paper No. 82240, SPE European Formation Damage Conference, The Hague, The Netherlands, May 13-14, 2003.
Pardo, et al.; "Corrosion Behaviour of Magnesium/Aluminium Alloys in 3.5 wt% NaC1"; Corrosion Science; 50; pp. 823-834; (2008).
Quik Drill Composite Frac Plug; Baker Hughes, Baker Oil Tools; Copyright 2002; 3 pages.
Shi, et al.; "Influence of the Beta Phase on the Corrosion Performance of Anodised Coatings on Magnesium-Aluminium Alloys"; Corrosion Science; 47; pp. 2760-2777; (2005).
Shimizu, et al., "Multi-walled carbon nanotube-reinforced magnesium alloy composites", Scripta Materialia, vol. 58, Issue 4, Feb. 2008, pp. 267-270.
Shumbera, et al. "Improved Water Injector Performance in a Gulf of Mexico Deepwater Development Using an Openhole Frac Pack Completion and Downhole Filter System: Case History." SPE Annual Technical Conference and Exhibition, Oct. 5-8, 2003.
Song, et al.; "Corrosion Mechanisms of Magnesium Alloys"; Advanced Engineering Materials; 1(1); pp. 11-33; (1999).
Song, et al.; "Influence of Microstructure on the Corrosion of Diecast AZ91D"; Corrosion Science; 41; pp. 249-273; (1999).
Song, et al.; "Understanding Magnesium Corrosion"; Advanced Engineering Materials; 5; No. 12; pp. 837-858; (2003).
Sun, et al.; "Colloidal Processing of Carbon Nanotube/Alumina Composites" Chem. Mater. 2002, 14, pp. 5169-5172.
Vickery, et al.; "New One-Trip Multi-Zone Frac Pack System with Positive Positioning." European Petroleum Conference, Oct. 29-31, 2002, Aberdeen, UK. [Abstract Only].
Zeng, et al. "Progress and Challenge for Magnesium Alloys as Biomaterials," Advanced Engineering Materials, vol. 10, Issue 8, Aug. 2008, pp. B3-B14.
Zhang, et al.; "High Strength Nanostructured Materials and Their Oil Field Applications"; Society of Petroleum Engineers; Conference Paper SPE 157092; SPE International Oilfield Nanotechnology Conference, 2012; 6 pages.
Zhang, et al.; "Metal Coating on Suspended Carbon Nanotubes and its Implication to Metal-Tube Interaction", Chemical Physics Letters 331 (2000) 35-41.
"Optisleeve Sliding Sleeve", [online]; [retrieved on Jun. 25, 2010]; retrieved from the Internet weatherford.com/weatherford/groups/ . . . /weatherfordcorp/WFT033159.pdf.
Baker Hughes, "Flow Control Systems," [online]; [retrieved on May 20, 2010]; retrieved from the Internet http://www.bakerhughes.com/products-and-services/completions-and-productions/well-completions/packers-and-flow-control/flow-control-systems.
Bououdina, et al., "Comparative Study of Mechanical Alloying of (Mg+Al) and (Mg+Al+Ni) Mixtures for Hydrogen Storage", J. Alloys, Compds, 2002, 336, 222-231.
Carrejo, et al., "Improving Flow Assurance in Multi-Zone Fracturing Treatments in Hydrocarbon Reservoirs with High Strength Corrodible Tripping Balls"; Society of Petroleum Engineers; SPE Paper No. 151613; Apr. 16, 2012; 6 pages.
Coronado, "Development of an Internal Coiled Tubing Connector Utilizing Permanent Packer Technology"; Society of Petroleum Engineers, SPE Paper No. 46036; Apr. 15, 1998; 10 pages.
Garfield, New One-Trip Sand-Control Completion System that Eliminates Formation Damage Resulting From conventional Perforating and Gravel-Packing Operations:, SPE Annual Technical Conference and Exhibition, Oct. 9-12, 2005.
Gray, et al., "Protective Coatings on Magnesium and Its Alloys—a Critical Review", Journal of Alloys and Compounds 336 (2002), pp. 88-113.
Hsiao, et al., "Anodization of AZ91D Magnesium Alloy in Silicate-Containing Electrolytes"; Surface & Coatings Technology; 199; pp. 127-134; (2005).
Hsiao, et al., "Characterization of Anodic Films Formed on AZ91D Magnesium Alloy"; Surface & Coatings Technology; 190; pp. 299-308; (2005).
Huo et al.; "Corrosion of AZ91D Magnesium Alloy with a Chemical Conversion Coating and Electroless Nickel Layer"; Corrosion Science: 46; pp. 1467-1477; (2004).
Kuzumaki, et al.; "Mechanical Characteristics and Preparation of Carbon Nanotube Fiber-Reinforced Ti Composite", Advanced Engineering Materials, 2000, 2, No. 7.
Liu, et al., "Calculated Phase Diagrams and the Corrosion of Die-Cast Mg—Al Alloys", Corrosion Science, 2009, 51, 606-619.
Lunder et al.; "The Role of Mg17Al12 Phase in the Corrosion of Mg Alloy AZ91"; Corrosion; 45(9); pp. 741-748; (1989).
Majumdar, et al., "Laser Surface Engineering of a Magnesium Alloy with Al + Al2O3", Surface and Coatings Technology 179 (2004) pp. 297-305.
Murray, "Binary Alloy Phase Diagrams" Int. Met. Rev., 30(5) 1985 vol. 1, pp. 103-187.
Nie, "Patents of Methods to Prepare Intermetallic Matrix Composites: A Review", Recent Patents on Materials Science 2008, vol. 1, pp. 232-240.

(56) References Cited

OTHER PUBLICATIONS

Saravanan et al., "Mechanically Alloyed Carbon Nanotubes (CNT) Reinforced Nanocrystalline AA 4032: Synthesis and Characterization," Journal of Minerals & Materials Characterization & Engineering, vol. 9, No. 11, pp. 1027-1035, 2010.
Shaw, "Benefits and Application of a Surface-Controlled Sliding Sleeve for Fracturing Operations"; Society of Petroleum Engineers, SPE Paper No. 147546; Oct. 30, 2011; 8 pages.
Song, "Recent Progress in Corrosion and Protection of Magnesium Alloys"; Advanced Engineering Materials; 7(7); pp. 563-586; (2005).
Song, et al.; "A Possible Biodegradable Magnesium Implant Material," Advanced Engineering Materials, vol. 9, Issue 4, Apr. 2007, pp. 298-302.
Song, et al.; "Corrosion Behaviour of AZ21, AZ501 and AZ91 in Sodium Chloride"; Corrosion Science; 40(10); pp. 1769-1791; (1998).
Triolo et al., "Resolving the Completion Engineer's Dilemma: Permanent or Retrievable Packer?"; Society of Petroleum Engineers, SPE Paper No. 76711; May 20, 2002; 16 pages.
Vernon Constien et al., "Development of Reactive Coatings to Protect Sand-Control Screens", SPE 112494, copyright 2008, Society of Petroleum Engineers, Presented at the 2008 SPE International Symposium and Exhibition on Formation Damage Control.
Walters, et al.; "A Study of Jets from Unsintered-Powder Metal Lined Nonprecision Small-Caliber Shaped Charges", Army Research Laboratory, Aberdeen Proving Ground, MD 21005-5066; Feb. 2001.
Wang, et al., "Contact-Damage-Resistant Ceramic/Single-Wall Carbon Nanotubes and Ceramic/Graphite Composites" Nature Materials, vol. 3, Aug. 2004, pp. 539-544.
Watanabe, et al., "Superplastic Deformation Mechanism in Powder Metallurgy Magnesium Alloys and Composites", Acta mater. 49 (2001) pp. 2027-2037.
Watarai, Trend of research and development for magnesium alloys—reducing the weight of structural materials in motor vehicles, (2006) Science and technology trends, Quaterly review No. 18, 84-97.
Welch, et al., "Nonelastomeric Sliding Sleeve Maintains Long Term Integrity in HP/HT Application: Case Histories" [Abstract Only], SPE Eastern Regional Meeting, Oct. 23-25, 1996, Columbus. Ohio.
Xu, et al., "Nanostructured Material-Based Completion Tools Enhance Well Productivity"; International Petroleum Technology Conference; Conference Paper IPTC 16538; International Petroleum Technology Conference 2013; 4 pages.
Zhan, et al., "Single-wall carbon nanotubes as attractive toughening agents in alumina-based nanocomposites" Nature Materials, vol. 2., Jan. 2003, pp. 38-42.
Zhang, et al.; "Formation of metal nanowires on suspended single-walled carbon nanotubes" Applied Physics Letter, vol. 77, No. 19 (2000), pp. 3015-3017.
Zhang, et al.; "Study on the Environmentally Friendly Anodizing of AZ91D Magnesium Alloy"; Surface and Coatings Technology: 161; pp. 36-43; (2002).
Zhu, et al., "The process of coating on ultrafine particles by surface hydrolysis reaction in a fluidized bed reactor", Surface and Coatings Technology 135 (2000) 14-17.
Adams, et al.; "Thermal stabilities of aromatic acids as geothermal tracers", Geothermics, vol. 21, No. 3, 1992, pp. 323-339.
Aviles et al, "Degradable Alternative to Risky Mill-Out Operations in Plug and Perf"; SPE-173695-MS; Society of Petroleum Engineers; SPE/ICOTA Coiled Tubing & Well Intervention Conference & Exhibition; Mar. 24-25, 2015; 10 Pages.
Ayman, et al.; "Effect of Consolidation and Extrusion Temperatures on Tensile Properties of Hot Extruded ZK61 Magnesium Alloy Gas Atomized Powders via Spark Plasma Sintering", Transactions of JWRI, vol. 38 (2009), No. 2, pp. 1-5.
Baker Hughes Incorporated. IN-Tallic Disintegrating Frac Balls. Houston: Baker Hughes Incorporated, 2011. Accessed Mar. 6, 2015.
Baker Hughes, "Multistage", Oct. 31, 2011, BakerHughes.com; accessed Mar. 6, 2015.
Bin et al., "Advances in Fluidization CVD Technology", East China University of Chemical Technology, China Academic Journal Electronic Publishing House, vol. 13, No. 4, Nov. 1992, pp. 360-365, English Abstract on p. 366.
Chuan-Jun et al., "Study on Corrosion Kinetics of Mg—Ni alloys", Journal of Kunming University of Science and Technology, vol. 34, No. 5, pp. 10-13, Oct. 2009.
International Search Report and Written Opinion, International Application No. PCT/US2016/041849, dated Oct. 26, 2016, Korean Intellectual Property Office; International Search Report 5 pages, Written Opinion 7 pages.
Lin et al., "Processing and Microstructure of Nano-Mo/Al2O3 Composites from MOCVD and Fluidized Bed", Nanostructured Materials, Nov. 1999, vol. 11, No. 8, pp. 1361-1377.
M.S. Senthil Saravanan et al, "Mechanically Alloyed Carbon Nanotubes (CNT) Reinforced Nanocrystalline AA 4032: Synthesis and Characterization", Journal of Minerals and Materials Characterization and Engineering, vol. 9, No. 11 pp. 1027-1035 2010.
Reid, Gary Carl, "Literature evaluation of induced groundwater tracers, field tracer techniques, and hydrodynamic dispersion values in porous media", Theisis in Geosciences (Masters), Texas Tech University, Aug. 1981, 109 pages.
Rose, et al.; "The application of the polyaromatic sulfonates as tracers in geothermal reservoirs", Geothermics 30 (2001) pp. 617-640.
Shigematsu, et al., "Surface Treatment of AZ91D Magnesium Alloy by Aluminum diffusion Coating", Journal of Materials Science Letters 19, 2000, pp. 473-475.
Singh, et al., "Extended Homogeneity Range of Intermetallic Phases in Mechanically Alloyed Mg—Al Alloys", Elsevier Sciences Ltd., Intemetallics 11, 2003, pp. 373-376.
Spencer et al., "Fluidized Bed Polymer Particle ALD Process for Producing HDPE/Alumina Nanocomposites", The 12th International Conference on Fluidization—New Horizons in Fluidization Engineering, vol. RP4 (2007).
Stanley, et al.; "An Introduction to Ground-Water Tracers", Department of Hydrology and Water Resources, University of Arizona, Mar. 1985, pp. 1-219.
Tsipas et al. "Effect of High Energy Ball Milling on Titanium-Hydroxyapatite Powders" Powder Metallurgy, Maney Publishing, London, GB, vol. 46, No. 1, Mar. 2003 (Mar. 2003), pp. 73-77.
Zemel, "Tracers in the Oil Field", University of Texas at Austin, Center for Petroleum and Geosystems, Jan. 1995, Chapters 1, 2, 3, 7.
"Sliding Sleeve", Omega Completion Technology Ltd, Sep. 29, 2009, retrieved on: www.omega-completion.com.
Ambat, et al., "Electroless Nickel-Plating on AZ91D Magnesium Alloy: Effect of Substrate Microstructure and Plating Parameters"; Surface and Coatings Technology; 179; pp. 124-134; (2004).
Baker Oil Tools, "Baker Oil Tools Introduces Revolutionary Sand Control Completion Technology," May 2, 2005.
Baker Oil Tools, "Z-Seal Metal-to-Metal Expandable Sealing Device Uses Expanding Metal in Place of Elastomers," Nov. 6, 2006.
Bastow, et al., "Clustering and formation of nano-precipitates in dilute aluminum and magnesium alloys", Materials Science and Engineering, 2003, C23, 757-762.
Bercegeay, et al., "A One-Trip Gravel Packing System"; Society of Petroleum Engineers, Offshort Technology Conference, SPE Paper No. 4771; Feb. 7-8, 1974.
Bybee, "One-Trip Completion System Eliminates Perforations," Completions Today, Sep. 2007, pp. 52-53.
Chang, et al., "Electrodeposition of Aluminum on Magnesium Alloy in Aluminum Chloride (A1C13)-1-ethyl-3-methylimidazolium chloride (EMIC) Ionic Liquid and Its Corrosion Behavior"; Electrochemistry Communications; 9; pp. 1602-1606; (2007).
Christoglou, et al., "Deposition of Aluminum on Magnesium by a CVD Process", Surface and Coatings Technology 184 (2004) 149-155.
Constantine, "Selective Production of Horizontal Openhole Completions Using ECP and Sliding Sleeve Technology." SPE Rocky Mountain Regional Meeting, May 15-18, 1999, Gillette, Wyoming. [Abstract Only].

(56) References Cited

OTHER PUBLICATIONS

Curtin, et al., "CNT-reinforced ceramics and metals," Materials Today, 2004, vol. 7, pp. 44-49.
Flahaut, et al., "Carbon Nanotube-Metal-Oxide Nanocomposites: Microstructure, Electrical Conductivity and Mechanical Properties" Acta amter. 48 (2000), pp. 3803-3812.
Forsyth, et al.; "An Ionic Liquid Surface Treatment for Corrosion Protection of Magnesium Alloy AZ31"; Electrochem. Solid-State Lett. 2006 vol. 9, Issue 11, B52-B55/ 9(11); Abstract only; 1 page.
Galanty, et al. "Consolidation of metal powders during the extrusion process," Journal of Materials Processing Technology (2002), pp. 491-496.
Garfield, "Formation Damage Control Utilizing Composite-Bridge-Plug Technology for Monobore, Multizone Stimulation Operations," SPE 70004, 2001, Society of Petroleum Engineers Inc., This paper was prepared for presentation at the SPE Per.
Garfield, et al., "Maximizing Inflow Performance in Soft Sand Completions Using New One-trip Sand Control Liner Completion Technology", SPE European Formation Damage Conference, May 25-27, 2005.
Goh, et al., "Development of novel carbon nanotube reinforced magnesium nanocomposites using the powder metallurgy technique", Nanottechnology 17 (2006) 7-12.
Han, et al., "Mechanical Properties of Nanostructured Materials", Rev. Adv. Mater. Sci. 9(2005) 1-16.
Hermawan, et al., "Iron-manganese: new class of metallic degradable biomaterials prepared by powder metallurgy", Powder Metallurgy, vol. 51, No. 1, (2008), pp. 38-45.
Hjortstam, et al. "Can we achieve ultra-low resistivity in carbon nanotube-based metal composites," Applied Physics A (2004), vol. 78, Issue 8, pp. 1175-1179.
Hsiao, et al., "Baking Treatment Effect on Materials Characteristics and Electrochemical Behavior of anodic Film Formed on AZ91D Magnesium Alloy"; Corrosion Science; 49; pp. 781-793; (2007).
Hsiao, et al., "Effect of Heat Treatment on Anodization and Electrochemical Behavior of AZ91D Magnesium Alloy"; J. Mater. Res.; 20(10); pp. 2763-2771;(2005).
Lavernia, et al.,"Cryomilled Nanostructured Materials: Processing and Properties", Materials Science and Engineering A, 493, (2008) pp. 207-214.
Li, "Design of Abrasive Water Jet Perforation and Hydraulic Fracturing Tool," Oil Field Equipment, Mar. 2011.
Maisano, "Cryomilling of Aluminum-Based and Magnesium-Based Metal Powders", Thesis, Virginia Tech, Jan. 13, 2006.
Seyni, et al., "On the interest of using degradable fillers in co-ground composite materials", Powder Technology 190, (2009) pp. 176-184.
Vahlas, et al., "Principles and Applications of CVD Powder Technology", Materials Science and Engineering R 53 (2006) pp. 1-72.

* cited by examiner

METHODS OF MANUFACTURING DISSOLVABLE TOOLS VIA LIQUID-SOLID STATE MOLDING

BACKGROUND

The disclosure is directed to methods of manufacturing dissolvable tools, and in particular to liquid-solid state molding methods of manufacturing dissolvable tools.

Oil and natural gas, or carbon dioxide sequestration wells often utilize wellbore components or tools that, due to their function, are only required to have limited service lives that are considerably less than the service life of the well. After a component or tool service function is complete, it must be removed or disposed of in order to recover the original size of the fluid pathway for use, including hydrocarbon production, $CO_2$ sequestration, etc.

To facilitate removal, such tools or components may be formed of a corrodible material so that they need not be physically removed by, for example, a mechanical operation, but may instead corrode or dissolve under downhole conditions.

Despite all the advances, the art is still receptive to alternative methods of manufacturing dissolvable tools, in particular methods having increased manufacturing capacity and reduced material cost.

BRIEF DESCRIPTION

A method of manufacturing a dissolvable article comprises: forming a liquid-solid mixture comprising secondary particles homogeneously dispersed in a molten metallic matrix material; disposing the liquid-solid mixture in a mold; agitating the liquid-solid mixture in the mold; and molding the liquid-solid mixture under agitation to form a dissolvable article, wherein the secondary particles and the metallic matrix material form a plurality of micro- or nano-sized galvanic cells in the dissolvable article.

Also disclosed is a dissolvable article comprising a metallic matrix comprising a plurality of grains formed from a metallic matrix material; the grains having a size of about 5 microns to about 300 microns; and secondary particles disposed on grain boundaries of the grains formed from the metallic matrix material; the secondary particles having a size of about 0.1 micron to about 2 microns; wherein the secondary particles and the metallic matrix material form a plurality of micro- or nano-sized galvanic cells in the dissolvable article.

BRIEF DESCRIPTION OF THE DRAWINGS

Referring now to the drawings wherein like elements are numbered alike in the several Figures.

DETAILED DESCRIPTION

Figure 1:
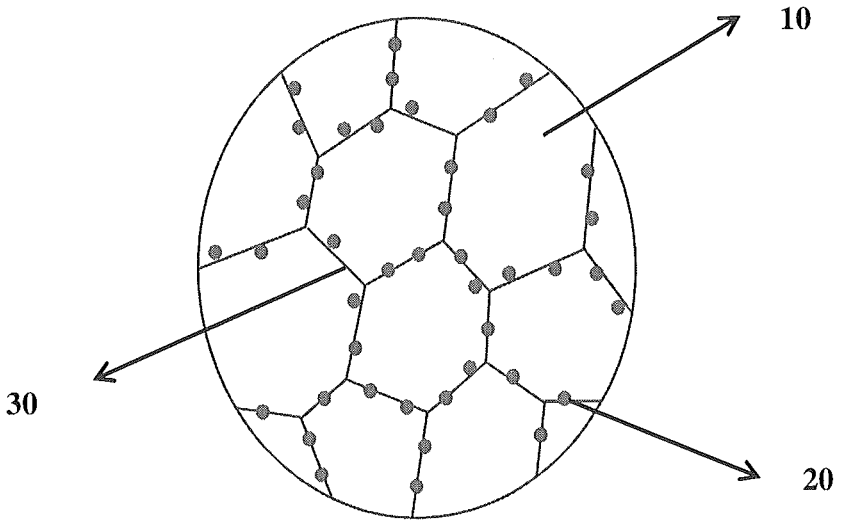
FIG. 1 illustrates the microstructure of an article according to an embodiment of the disclosure.

The inventors hereof have found that dissolvable tools can be made by liquid-solid state molding. The method increases the manufacture capacity as the size of the tools made from the method is almost unlimited. Moreover, the method has reduced material cost. As a further advantageous feature, the dissolvable tools made from the method have adjustable and uniform dissolution rates.

The method comprises forming a liquid-solid mixture comprising secondary particles homogeneously dispersed in a molten metallic matrix material; disposing the liquid-solid mixture in a mold; agitating the liquid-solid mixture in the mold; and molding the liquid-solid mixture under agitation to form the dissolvable article.

The matrix material comprises one or more of the following: a magnesium-based alloy; an aluminum-based alloy; or a zinc-based alloy. As used herein, the term "metal-based alloy" means a metal alloy wherein the weight percentage of the specified metal in the alloy is greater than the weight percentage of any other component of the alloy, based on the total weight of the alloy.

Magnesium-based alloys suitable for use include alloys of magnesium with aluminum (Al), cadmium (Cd), calcium (Ca), cobalt (Co), copper (Cu), iron (Fe), manganese (Mn), nickel (Ni), silicon (Si), silver (Ag), strontium (Sr), thorium (Th), tungsten (W), zinc (Zn), zirconium (Zr), or a combination comprising at least one of these elements. Alloying or trace elements can be included in varying amounts to adjust the corrosion rate of the magnesium. Exemplary commercial magnesium-based alloys which include different combinations of the above alloying elements to achieve different degrees of corrosion resistance include but are not limited to, for example, those alloyed with aluminum, strontium, and manganese such as AJ62, AJ50x, AJ51x, and AJ52x alloys, and those alloyed with aluminum, zinc, and manganese such as AZ91A-E alloys. Other exemplary magnesium-based alloys include MgZrZn, MgAlZn, AlCuZnMn, and AlMgZnSiMn.

Aluminum-based alloys include all alloys that have aluminum as an alloy constituent. Exemplary aluminum alloys include Al—Cu alloy, Al—Mn alloy, Al—Si alloy, Al—Mg alloy, Al—Mg—Si alloy, Al—Zn alloy, Al—Li alloy, Al—Cu—Mg—X alloy, Al—Zn—Mg—Cu—X, where X represents alloying elements including Zn, Mn, Si, Cr, Fe, Ni, Ti, V, Cu, Pb, Bi, and Zr.

Zinc-based alloys include alloys of zinc with Al, Cu, Mg, Pb, Cd, Sn, Fe, Ni, Si, or a combination of the above elements. In a specific embodiment, the metallic matrix material is a magnesium alloy.

The metallic matrix material used to prepare the dissolvable article is in a particular form. The matrix particles have an initial average particle size from about 0.1 μm to about 500 μm, in an embodiment 0.5 μm to about 250 μm. The shape of the matrix particles may be regular or irregular. In an embodiment, the matrix particles may be, for example, spherical or oblong. Useful metallic matrix material has a corrosion rate of about 0.1 to about 200 $mg/cm^2$/hour, specifically about 1 to about 150 $mg/cm^2$/hour using aqueous 3 wt % KCl solution at 200° F. (93° C.).

The secondary particles, which have a lower reactivity relative to the metallic matrix material, acts as a cathode, whereas the metallic matrix, made of an alloy such as magnesium-based alloy which is more reactive than the secondary particles, is anodic relative to the secondary particles. A galvanic discharge cycle (e.g., corrosion) occurs between the relatively anodic and relatively cathodic materials in the presence of an electrolyte. By adjusting the compositions of the metallic matrix material and the secondary particles and the amount of the secondary particles relative to the metallic matrix, the corrosion rate of the dissolvable article is adjusted.

The secondary particles have a higher melting point as compared to the metallic matrix material so that the metallic matrix material can be selectively melted during the manufacturing process. In addition, the secondary particles and the metallic matrix material are selected such that they form micro- or nano-sized galvanic cells under the process conditions to make the dissolvable article. In particular, the secondary particles and the metallic matrix material are selected such that they do not form intermetallic compounds or a solid solution phase or only forms a solid solution phase with very small solubility under the process conditions so that all or a large portion (for example, greater than 90 wt. %, greater than about 95 wt. %, or greater than about 98 wt. %) of the secondary particles remain in their original composition and shape in the article. In an embodiment, less than about 10 wt. %, less than about 5 wt. %, or less than about 2 wt. % of secondary particles dissolve or form a solid solution phase or form an intermetallic compound with the metallic matrix material. Without wishing to be bound by theory, it is believed that if secondary particles react with the matrix material forming an intermetallic compound or solid solution and are fully consumed during the material processing, then the manufactured articles may not have galvanic cells thus are not dissolvable. Further without wishing to be bound by theory, it is believed that if less than 10 wt. % of secondary particles form a solid solution or intermetallic compound with the metallic matrix material during the process to prepare the dissolvable article, based on the total weight of the secondary particles, the articles prepared from such metallic matrix materials and secondary particles keep high chemical potential difference between the matrix and the secondary particles thus providing an article having a high dissolution rate.

Exemplary secondary particles include one or more of the following: a metal; an oxide of the metal; a nitride of the metal; or a cermet of the metal; wherein the metal is one or more of the following: W; Co; Cu; Ni; or Fe.

The amount of the secondary particles can vary depending on the specific materials used and desired corrosion rate. In an embodiment, the liquid-solid mixture comprises 0.01 to 10 wt. %, or 0.05 to 8 wt. %, or 0.1 to 6 wt. % of the secondary particles, based on the total weight of the liquid-solid mixture. In another embodiment, the weight ratio of the metallic matrix material relative to the secondary particles is about 99:1 to about 9:1 in the liquid-solid mixture.

One way to form the liquid-solid mixture is to mix the metallic matrix material in a solid form with the secondary particles to provide a blend; and heating the blend under agitation to selectively melt the metallic matrix material. Alternatively, the liquid solid mixture is made by heating the metallic matrix material in a solid form to provide a molten metallic matrix material; and introducing the secondary particles to the molten matrix material under agitation. Heating the blend and heating the metallic matrix material can be conducted at a temperature above the melting point of the metallic matrix material but below the melting point of the secondary particles. In an embodiment, the heating is to a temperature of about 600° C. to about 800° C. The heating can be conducted at atmospheric pressure in the presence or absence of an inert atmosphere. In another embodiment, less than about 10 wt. %, less than about 5 wt. %, less than about 2 wt. %, or less than about 1 wt % of the secondary particles dissolve under the process conditions.

To form a homogeneous liquid-solid mixture, an agitation force is applied to the metallic matrix material and the secondary particles. The agitation force can be generated by mechanical means, electromagnetic means, acoustic means, or a combination comprising at least one of the foregoing. For example, the metallic matrix material and the secondary particles can be mechanically stirred in a crucible or a furnace. A magnetic field can also be applied to the metallic matrix material and the secondary particles. By randomly changing the field direction, the magnitude, and the frequency of the field, an agitation force is generated. Alternatively or in addition to mechanical and electromagnetic forces, an acoustic generator such as a megasonic energy source imparts wave energy to the metallic matrix material and the secondary particles and thus agitating them during the mixing.

The homogeneous liquid-solid mixture is then disposed in a mold. The method of disposing is not particularly limited. For example, the homogeneous liquid-solid mixture can be poured into the mold, pushed into the mold under a superatmospheric pressure, or drawn to the mold under a subatmospheric pressure.

The molding can be a pressure molding or a vacuum molding. In an embodiment the molding is conducted at a pressure of about 500 psi to about 30,000 psi or about 1000 psi to about 5000 psi. The pressure can be a superatmospheric pressure or a subatmospheric pressure. In an embodiment, the mold is not heated. In another embodiment, the mold is heated to a temperature of about 200° F. to about 800° F. or about 300° F. to about 600° F.

During the molding, an agitation force is applied to the mixture by mechanical means, electromagnetic means, acoustic means, or a combination comprising at least one of the foregoing. Without wishing to be bound by theory, it is believed that without agitation, the secondary particles may separate out from the metallic matrix material. As a result, the secondary particles may not be uniformly distributed throughout the molded product; and the dissolvable article would not have a uniform dissolution rate.

The mold product is allowed to cool down to room temperature when the mold is still under pressure. In the instance where the molded product is subjected to a subsequent extrusion operation, the molded product can be cooled to a temperature above the room temperature. An agitation force is also applied to the molded product during the cooling process. The cooled article can be machined and used as is.

For applications requiring higher strength, the molded article is further extruded. During extrusion, the pores inside the molded product are fully closed to provide a condensed article having high tensile strength, high shear strength, and high compression strength. In addition, the extruded product dissolves more uniformly. The extrusion temperature is about 600° F. to about 800° F.

The dissolvable article has a microstructure comprising a plurality of grains formed from the metallic matrix material. The grains have an average size of about 5 to about 300 microns. The size of the secondary particles is about 0.1 micron to about 2 microns. The variation of the average particle size of the secondary particles in the final dissolvable article and the average particle size of the secondary particles used to make the dissolvable article is less than about 10%, less than about 5% or less than about 2% based on the initial average particle size of the secondary particles. In an embodiment, the secondary particles are disposed only on the grain boundaries. In another embodiment, the secondary particles are disposed both on the grain boundaries and inside the grains.

The dissolvable article thus has micron-sized or nano-sized galvanic cells where the metallic matrix is the anode and the secondary particles are cathode. The dissolvable article has uniform dissolution rate. In an embodiment, the dissolvable article has a corrosion rate of about 1 to about 300 mg/cm$^2$/hour, specifically about 10 to about 200 mg/cm$^2$/hour using aqueous 3 wt % KCl solution at 200° F. (93° C.).

Figure 2:
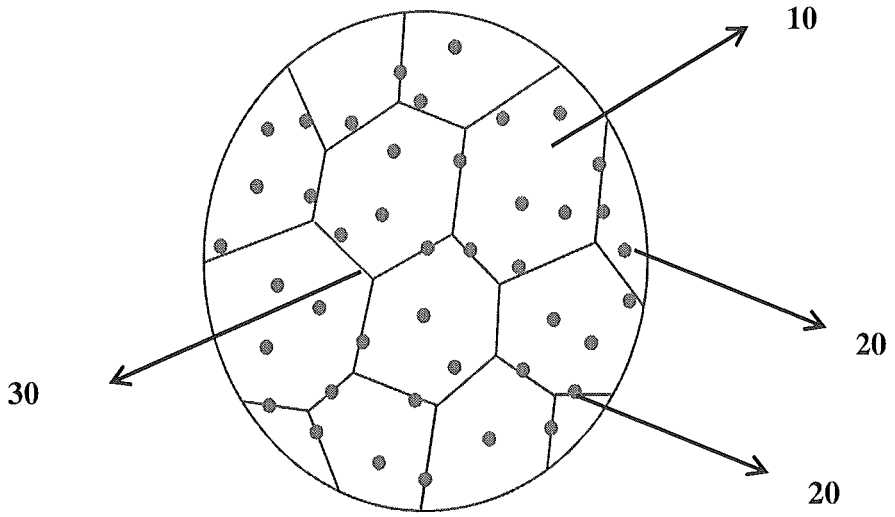
FIG. 2 illustrates the microstructure of an article according to another embodiment of the disclosure.

FIGS. 1 and 2 illustrate the microstructures of articles according to some embodiments of the disclosure. The dissolvable article has a plurality of grains 10 formed from a metallic matrix material. The grains form grain boundaries 30. In FIG. 1, the secondary particles 20 are only disposed on grain boundaries. In FIG. 2, the secondary particles 20 are disposed on the grain boundaries as well inside the grains.

Figure 3:
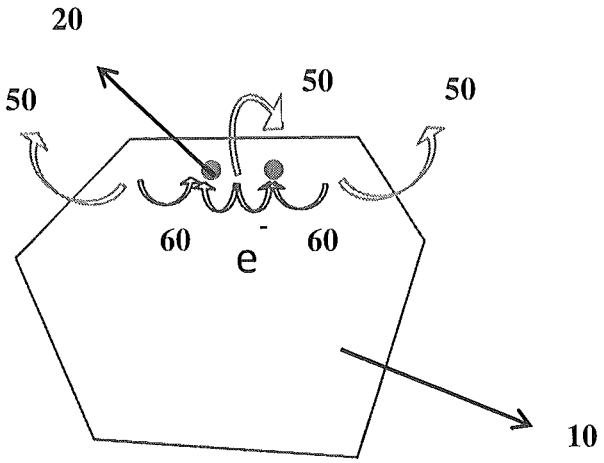
FIG. 3 illustrates the electrons' flowing directions during the dissolution of the article.

FIG. 3 shows a gain 10 and secondary particles 20 disposed in the grain. Because the metallic matrix material is more reactive than the secondary particles, the matrix material loses electrons and forms a cation. The electrons move from the metallic matrix material to the secondary particles. The direction of the electron movement is shown as 60 in FIG. 3. The cations formed from the matrix material dissolves in the electrolyte shown as 50 in FIG. 3. The presence of multiple micron-sized or nano-sized galvanic cells ensures that the reaction is conducted in a controllable manner.

Articles formed from the method disclosed herein are not particularly limited. Exemplary dissolvable articles include downhole articles such as a ball, a ball seat, a fracture plug, a bridge plug, a wiper plug, shear out plugs, a debris barrier, an atmospheric chamber disc, a swabbing element protector, a sealbore protector, a screen protector, a beaded screen protector, a screen basepipe plugs, a drill in stim liner plugs, ICD plugs, a flapper valve, a gaslift valve, a transmatic CEM plug, float shoes, darts, diverter balls, shifting/setting balls, ball seats, sleeves, teleperf disks, direct connect disks, drill-in liner disks, fluid loss control flappers, shear pins or screws, cementing plugs, teleperf plugs, drill in sand control beaded screen plugs, HP beaded frac screen plugs, hold down dogs and springs, a seal bore protector, a stimcoat screen protector, or a liner port plug.

All ranges disclosed herein are inclusive of the endpoints, and the endpoints are independently combinable with each other. As used herein, "combination" is inclusive of blends, mixtures, alloys, reaction products, and the like. All references are incorporated herein by reference.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." Further, it should further be noted that the terms "first," "second," and the like herein do not denote any order, quantity (such that more than one, two, or more than two of an element can be present), or importance, but rather are used to distinguish one element from another. The modifier "about" used in connection with a quantity is inclusive of the stated value and has the meaning dictated by the context (e.g., it includes the degree of error associated with measurement of the particular quantity). Unless defined otherwise, technical and scientific terms used herein have the same meaning as is commonly understood by one of skill in the art to which this invention belongs. As used herein, the size or average size of the particles refers to the largest dimension of the particles and can be determined by high resolution electron or atomic force microscope technology.

All references cited herein are incorporated by reference in their entirety. While typical embodiments have been set forth for the purpose of illustration, the foregoing descriptions should not be deemed to be a limitation on the scope herein. Accordingly, various modifications, adaptations, and alternatives can occur to one skilled in the art without departing from the spirit and scope herein.

What is claimed is:

1. A method of manufacturing a dissolvable article, the method comprising:

forming a liquid-solid mixture comprising secondary particles dispersed in a molten metallic matrix material;

disposing the liquid-solid mixture in a mold;

agitating the liquid-solid mixture in the mold;

molding the liquid-solid mixture under agitation to form a molded dissolvable article, wherein molding the liquid-solid mixture comprises applying a superatmospheric pressure of about 500 psi to about 30,000 psi to the liquid-solid mixture under agitation;

cooling the molded dissolvable article; and applying an agitating force to the molded dissolvable article during cooling thus forming the dissolvable article;

wherein the secondary particles have an original shape and an original composition before being dispersed in the molten metallic matrix material, and greater than about 90 wt. % of the secondary particles remain in the original shape and the original composition in the dissolvable article; and the secondary particles and the metallic matrix material form a plurality of micro- or nano-sized galvanic cells in the dissolvable article.

2. The method of claim 1 wherein less than 10 wt. % of the secondary particles form a solid solution, an intermetallic compound, or a combination thereof with the metallic matrix material, based on the total weight of the secondary particles.

3. The method of claim 1, wherein forming the liquid-solid mixture comprises:

mixing the metallic matrix material in a solid form with the secondary particles to provide a blend; and heating the blend under agitation to selectively melt the metallic matrix material.

4. The method of claim 1, wherein forming the liquid-solid mixture comprises:

heating the metallic matrix material in a solid form to provide a molten metallic matrix material; and introducing the secondary particles to the molten matrix material under agitation.

5. The method of claim 4, wherein heating the metallic matrix material is to a temperature of about 600° C. to about 700° C.

6. The method of claim 1, wherein agitating the liquid-solid mixture comprises applying an agitation force to the mixture by mechanical means, electromagnetic means, acoustic means, or a combination comprising at least one of the foregoing.

7. The method of claim 1, further comprising extruding the article.

8. The method of claim 1, wherein the metallic matrix material comprises one or more of the following: a magnesium-based alloy; an aluminum-based alloy; or a zinc-based alloy.

9. The method of claim 1, wherein the secondary particles comprise one or more of the following: a metal; an oxide of the metal; a nitride of the metal; or a cermet of the metal; wherein the metal is one or more of the following: W; Co; Cu; Ni; or Fe.

10. The method of claim 1, wherein the liquid-solid mixture comprises about 1 wt % to about 10 wt % of secondary particles, based on the total weight of the liquid solid mixture.

11. The method of claim 1, wherein the dissolvable article has a microstructure comprising a plurality of grains formed from the metallic matrix material.

12. The method of claim 11, wherein the secondary particles are disposed on grain boundaries of the grains formed from the metallic matrix material.

13. The method of claim 12, wherein the secondary particles are further disposed inside the grains.

14. The method of claim 1, wherein less than about 10 wt. % of the secondary particles form an intermetallic compound with the metallic matrix material, based on the total weight of the secondary particles.

15. The method of claim 14, wherein less than about 5 wt. % of the secondary particles form an intermetallic compound with the metallic matrix material, based on the total weight of the secondary particles.

16. The method of claim 1, wherein the secondary particles comprise one or more of the following: a metal; an oxide of the metal; a nitride of the metal; or a cermet of the metal; and the metal is W, Co, or a combination thereof.

17. The method of claim 1, wherein greater than about 95 wt. % of the secondary particles remain in the original form shape and the original composition in the dissolvable article.

18. The method of claim 1, wherein greater than about 98 wt. % of the secondary particles remain in the original shape and the original composition in the dissolvable article.

19. The method of claim 1, wherein the secondary particles comprise W, Co, or a combination thereof.

20. A method of manufacturing a dissolvable article, the method comprising:

forming a liquid-solid mixture comprising 0.1 to 6 wt. % of secondary particles homogeneously dispersed in a molten metallic matrix material based on the total weight of the liquid-solid mixture, the metallic matrix material comprising one or more of the following: a magnesium-based alloy; an aluminum-based alloy; or a zinc-based alloy, and the secondary particles comprising a metal; an oxide of the metal; a nitride of the metal; or a cermet of the metal; wherein the metal is one or more of the following: W; Co; Cu; Ni; or Fe;

disposing the liquid-solid mixture in a mold;

agitating the liquid-solid mixture in the mold;

molding the liquid-solid mixture under agitation to form a dissolvable molded article, wherein molding the liquid-solid mixture comprises applying a superatmospheric pressure of about 1,000 psi to about 5,000 psi to the liquid solid mixture under agitation;

cooling the molded dissolvable article; and applying an agitating force to the molded dissolvable article during cooling thus forming the dissolvable article;

wherein the secondary particles have an original shape and an original composition before being dispersed in the molten metallic matrix material, and greater than about 98 wt. % of the secondary particles remain in the original shape and the original composition in the dissolvable article; and the secondary particles and the metallic matrix material form a plurality of micro- or nano-sized galvanic cells in the dissolvable article.

21. The method of claim 20, wherein the secondary particles comprise W, Co, or a combination thereof.

* * * * *